US006769906B1

(12) United States Patent
Grove et al.

(10) Patent No.: US 6,769,906 B1
(45) Date of Patent: Aug. 3, 2004

(54) FIRE EFFECT APPLIANCE

(76) Inventors: James E. Grove, 4316 Marina City Dr., #423CTN, Marina del Rey, CA (US) 90292; Vong Siew Fun, 927 Amoroso Pl., Venice, CA (US) 90291; Raymond M. Carter, P.O. Box 13102, Marina del Rey, CA (US) 90295

( * ) Notice: Subject to any disclaimer, the term of this patent is extended or adjusted under 35 U.S.C. 154(b) by 51 days.

(21) Appl. No.: 10/214,973

(22) Filed: Aug. 8, 2002

(51) Int. Cl.[7] ..... F23D 3/40; F24B 1/181

(52) U.S. Cl. ..... 431/326; 431/354; 126/519

(58) Field of Search ..... 431/326, 328, 431/126, 170, 7, 125, 354, 350; 126/512, 500, 519, 92 R, 110 D, 116 R

(56) References Cited

U.S. PATENT DOCUMENTS

| | | | | | |
|---|---|---|---|---|---|
| 344,808 | A | * | 7/1886 | Bradberry | 126/512 |
| 1,074,110 | A | * | 9/1913 | Fyfe | 431/328 |
| 1,238,632 | A | * | 8/1917 | Caister | 431/170 |
| 1,846,878 | A | | 2/1932 | Kopp | |
| 2,090,248 | A | | 8/1937 | Chakow | |
| 2,535,500 | A | | 12/1950 | Looft | |
| 2,548,932 | A | | 4/1951 | Ball | |
| 2,866,956 | A | | 12/1958 | Miller et al. | |
| 2,897,330 | A | | 7/1959 | Hopkins | |
| 3,221,137 | A | | 11/1965 | Madden | |
| 3,582,250 | A | * | 6/1971 | Chatfield | 431/125 |
| 3,617,693 | A | | 11/1971 | Shimosawa | |
| 3,980,027 | A | | 9/1976 | Maes | |
| 4,034,200 | A | | 7/1977 | Visagie | |
| 4,038,518 | A | | 7/1977 | Morton et al. | |
| 4,060,038 | A | | 11/1977 | Ruvolo | |
| 4,120,248 | A | | 10/1978 | Broach | |
| D253,931 | S | | 1/1980 | DeVischer et al. | |
| D262,427 | S | | 12/1981 | Boston et al. | |
| 4,349,713 | A | | 9/1982 | Marsen | |
| D270,399 | S | | 9/1983 | Miller | |
| D270,987 | S | | 10/1983 | Scheufler | |
| 4,481,408 | A | | 11/1984 | Scheufler | |
| D286,002 | S | | 10/1986 | Brix | |
| 4,616,626 | A | | 10/1986 | Kwan Soon | |
| 4,759,276 | A | | 7/1988 | Segroves | |
| 4,840,128 | A | | 6/1989 | McFarlane et al. | |
| 4,910,372 | A | | 3/1990 | Vukich | |
| 5,000,162 | A | * | 3/1991 | Shimek et al. | 126/512 |
| 5,077,460 | A | | 12/1991 | Rocha et al. | |
| 5,168,796 | A | | 12/1992 | Porton et al. | |
| 5,290,997 | A | | 3/1994 | Lai et al. | |
| 5,320,520 | A | * | 6/1994 | Barth et al. | 431/125 |
| D350,045 | S | | 8/1994 | Stuart | |
| 5,421,271 | A | | 6/1995 | Sui | |
| D389,009 | S | | 1/1998 | Baykal | |
| D394,779 | S | | 6/1998 | Hilvitz | |
| 5,775,315 | A | | 7/1998 | Baykal | |
| 5,816,171 | A | | 10/1998 | Fitts, Jr. | |
| 5,868,128 | A | * | 2/1999 | Omar | 126/512 |
| 5,937,764 | A | | 8/1999 | Olivier | |
| 6,065,466 | A | | 5/2000 | Baykal | |
| 6,186,055 | B1 | | 2/2001 | DeMars et al. | |
| 6,192,881 | B1 | * | 2/2001 | Nix | 126/512 |
| 6,279,465 | B1 | | 8/2001 | English | |
| 6,354,288 | B1 | * | 3/2002 | McDonald | 126/519 |

FOREIGN PATENT DOCUMENTS

| | | | | |
|---|---|---|---|---|
| WO | WO 89/00267 | * | 1/1989 | F24C/3/00 |

* cited by examiner

*Primary Examiner*—Josiah Cocks
(74) *Attorney, Agent, or Firm*—Jack C. Munro

(57) ABSTRACT

A fire effect appliance which utilizes a bowl to which is to be supplied a flammable gas. The internal chamber of the fire bowl includes a diffusing device which is to function to evenly distribute the gas throughout a particulate matter contained within the internal chamber of the fire bowl. The fire bowl can be placed on a freestanding stand or mounted within a table. A fan and shroud can be mounted in conjunction with the fire bowl for the purpose of propelling the heated air exteriorly of the fire bowl so the appliance can also function as a heater.

8 Claims, 3 Drawing Sheets

FIRE EFFECT APPLIANCE

BACKGROUND OF THE INVENTION

1. Field of the Invention

The field of this invention relates to ornamental devices and more particularly to an appliance which is designed to generate a dancing flame to achieve a desirable ornamental effect.

2. Description of the Related Art

A common form of a fire effect appliance is what is deemed a conversation pit. Generally, a conversation pit is a hole in the ground that is surrounded with rock or brick. Typical pits are around four feet in diameter. Wood is to be placed within the pit and when burning produces a desirable environment for people to gather around and engage in conversation. Prior to the present invention, it has not been known to utilize this same concept in conjunction with a table mounted appliance.

What is believed to be the closest prior art would be a cooking appliance which comprises a small -unit that would burn charcoal that could be placed on a table. However, the structure of the present invention is not intended to be used in cooking.

SUMMARY OF THE INVENTION

A main embodiment of a fire effect appliance which comprises a fire bowl which has an internal chamber. A diffusing device is placed within the internal chamber and rests on the fire bowl. A gas supply chamber is formed between the diffusing device and the fire bowl. A quantity of particulate matter substantially fills the internal chamber of the fire bowl covering the diffusing device. The particulate matter has a substantially level top surface. An opening is formed in the fire bowl with this opening connecting with the gas supply chamber. The opening is to connect with a source of flammable gas. As gas is supplied to the gas supply chamber and flows in conjunction with the diffusing device into the internal chamber and the gas becomes evenly dispersed throughout the particulate matter and when ignited produces a dancing flame effect on the top surface of the particulate matter.

A further embodiment of the present invention comprises the main embodiment being modified by the diffusing device comprising a plate.

A further embodiment of the present invention is where the just previous embodiment is modified by the plate being defined as circular.

A further embodiment of the present invention is where the just previous embodiment is modified by the diffusing plate having a centrally mounted protruding pin which is to fit within a hole formed within the fire bowl to quickly align in position the diffusing plate with this pin protruding from the bottom surface of the diffusing plate.

A further embodiment of the present invention is where the main embodiment is modified by the appliance being mounted in conjunction with a table.

A further embodiment of the present invention is where the just previous embodiment is modified by there being formed a hole in the table and the fire bowl is mounted within the hole.

A further embodiment of the present invention is where the main embodiment is modified by a gas bottle being mounted in conjunction with the fire bowl.

A further embodiment of the present invention is where the main embodiment is modified by the fire bowl being mounted on a shroud with there being formed a gap area between the shroud and the fire bowl. An electrically operated fan is connected to the shroud to move air across the fire bowl and exteriorly of the fire bowl so that the appliance can also function as a heater.

A further embodiment of the present invention is where the main embodiment is modified by the fire bowl being mounted on a freestanding stand which is to be located on a supporting surface.

A further embodiment of the present invention is where the circular plate that is used as the diffusing means has a diameter that is within the range of fifty-seven to sixty percent of the largest diameter of the internal chamber of the fire bowl which produces an even disbursement of the gas through the particulate matter.

A further embodiment of the present invention is where the just previous embodiment is modified by the particulate matter having a depth of between fourteen to eighteen percent of the largest diameter of the internal chamber of the fire bowl.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
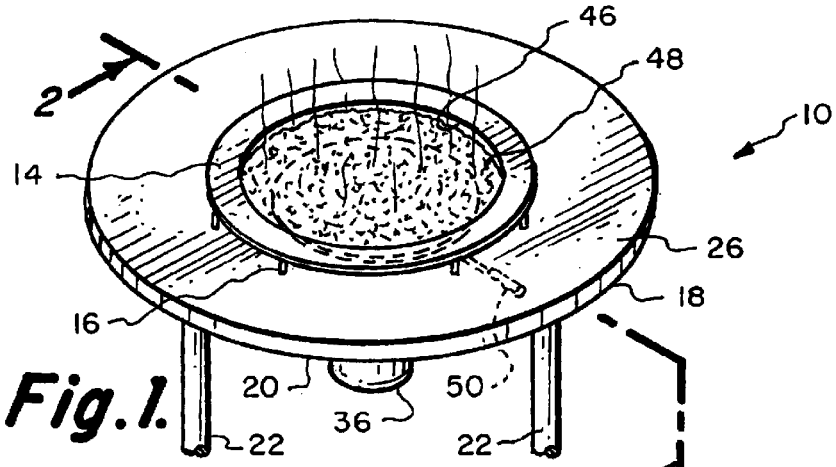
FIG. 1 is an exterior isometric view of a first embodiment of fire effect appliance of this invention showing the fire bowl mounted within a hole formed within a table.
Figure 2:
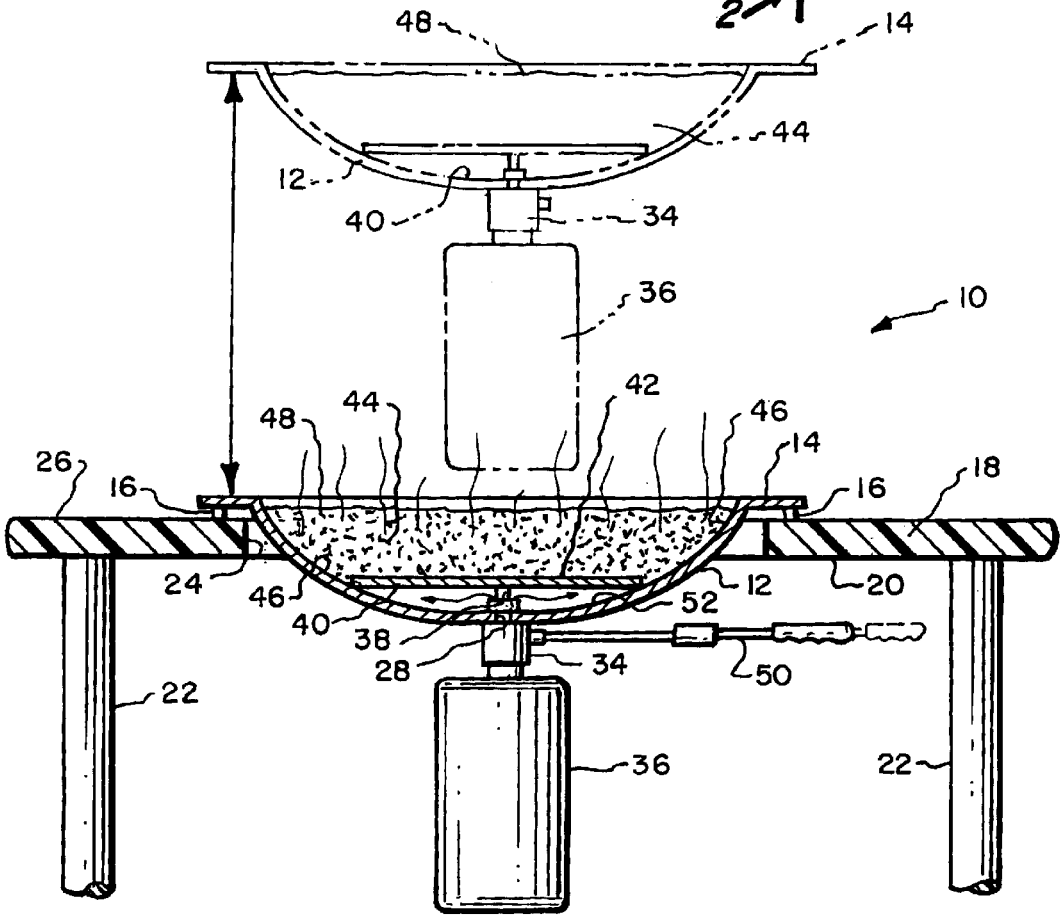
FIG. 2 is a cross-sectional view taken along line 2—2 of FIG. 1 depicting how the appliance can be removed from the table.

Referring particularly to the drawings, there is shown in FIGS. 1 and 2 the first embodiment 10 of fire effect appliance of this invention. The appliance 10 utilizes a fire bowl 12 which generally will be in the range of eight to fourteen inches in diameter. The upper edge of the fire bowl 12 is formed into an annular flat flange 14. Mounted on the undersurface of the annular flange 14 are a plurality of pegs 16. These pegs 16 are to function as feet which are to be placed against a table 18. Table 18 will normally be constructed of a rigid material, such as metal, wood or plastic.

Mounted to the undersurface 20 of the table 18 are a plurality of supporting legs 22. The legs 22 are to be placed on an appropriate supporting surface, such as a patio, deck or even ground, which is not shown.

Formed within the table 18 is an enlarged centrally located hole 24. Although it is not mandatory that the hole 24 be centrally located, such will normally be the case. The fire bowl 12 is to be located within the hole 24. The pegs 16 are to be placed in contact with the upper surface 26 of the table 18. Because the fire bowl 12 will become quite heated, the purpose of the pegs 16 are to locate the fire bowl 12 in a non-contactual relationship with the table 18. This is so as to keep the fire bowl 12 from burning of the table 18. The pegs 16 may be constructed of a non-heat conductive material.

Normally, the fire bowl 12 will be constructed of a metallic material, such as steel or aluminum. The fire bowl 12 includes a center hole 28 which is centrally mounted relative to the fire bowl 12 with the hole 28 always being approximately the same distance from the annular flange 14 in any direction from the hole 28 to the flange 14. Mounted in conjunction with the center hole 28 is a discharge nozzle 30. Discharge nozzle 30 has a through hole 32. Typically, this hole 32 will be cylindrical.

Fixedly mounted to the fire bowl 12 is a tubular connector 34. This tubular connector 34 is to facilitate connection with a gas bottle 36. The tubular connector 34 is to establish a gastight connection with the bottle 36. The tubular connector 34 facilitates removal of an empty bottle 36 and reconnection with a bottle 36 that is full of the flammable gas.

The through hole 32 is constructed to be large enough (oversized) to also accommodate a protruding pin 38. Gas is to be dispensed through the through hole 32 of discharge nozzle 30 and around pin 38 into gas supply chamber 52. This protruding pin 38 is fixedly mounted to the underside 40 of a diffusing plate 42. The diffusing plate 42 normally comprises a flat, circular metallic plate, usually constructed of steel. The diffusing plate 42 must have a specific diameter relative to the largest diameter of the fire bowl 12. The largest diameter of the fire bowl 12 is located directly adjacent the annular flange 14. It is found to be desirable to have the diameter of the diffusing plate 42 to be in the range of fifty-seven to sixty percent of the largest diameter of the fire bowl 12. Also, there is to be located particulate matter 44 in the internal chamber 46 of the fire bowl 12. This particulate matter 44 will normally comprise sand but could also comprise a gravel or any other type of particulate that is capable of being heated. The particulate matter 44 is to be filled to a top surface 48. The depth of the particulate matter 44 from the top surface 48 to the diffusing plate 40 would normally comprise between fourteen and eighteen percent of the largest diameter of the fire bowl 12. It is to be understood that the smaller the diameter of the fire bowl 12 the less the depth of the particulate matter 44. The greater the diameter of the fire bowl 12 the greater depth of the particulate matter 44. The same is also true of the diffusing plate 40. The smaller the diameter of the fire bowl 12 the smaller the diameter of the diffusing plate 40 still maintaining the relationship of approximately somewhere between fifty-seven to sixty percent of the largest diameter of the fire bowl 12.

The connector 34 is to include a valve, which is not shown. The valve is to be operable from an on and off position by means of a manually graspable arm 50. When the arm is in the solid line position shown in FIG. 2, the valve will be closed not permitting passage of flammable gas from the bottle 36 to within the gas supply chamber 52 that is located between the diffusing plate 42 and the fire bowl 12. However, when the arm 50 is in the dotted line position of FIG. 2, the valve will be open which will permit the supply of gas from the bottle 36 into the gas supply chamber 52. The gas from the gas supply chamber 52 is to be dispensed about the peripheral edge of the diffusing plate 42 to permeate the particulate matter 44 and passed there through. At the top surface 48, the gas is to be ignited which will then produce a dancing flame across the top surface 48.

Figure 3:
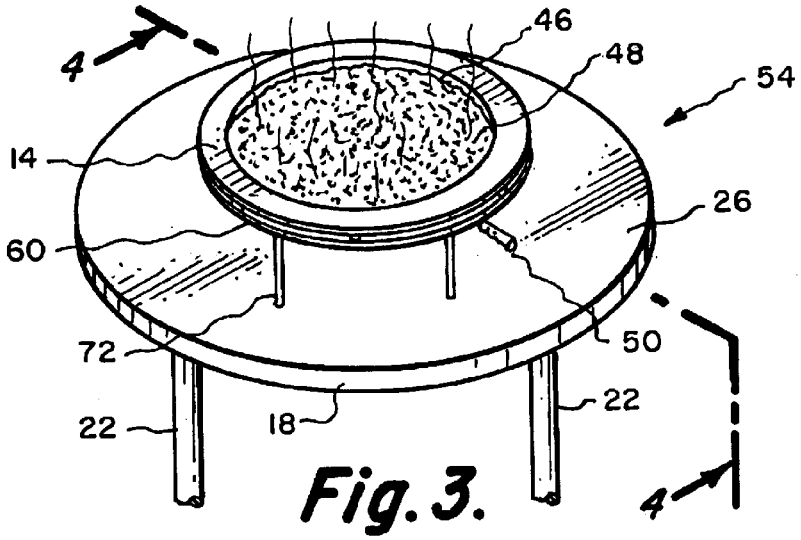
FIG. 3 is an isometric view of a second embodiment of fire effect appliance showing such being mounted in conjunction with a table.
Figure 4:
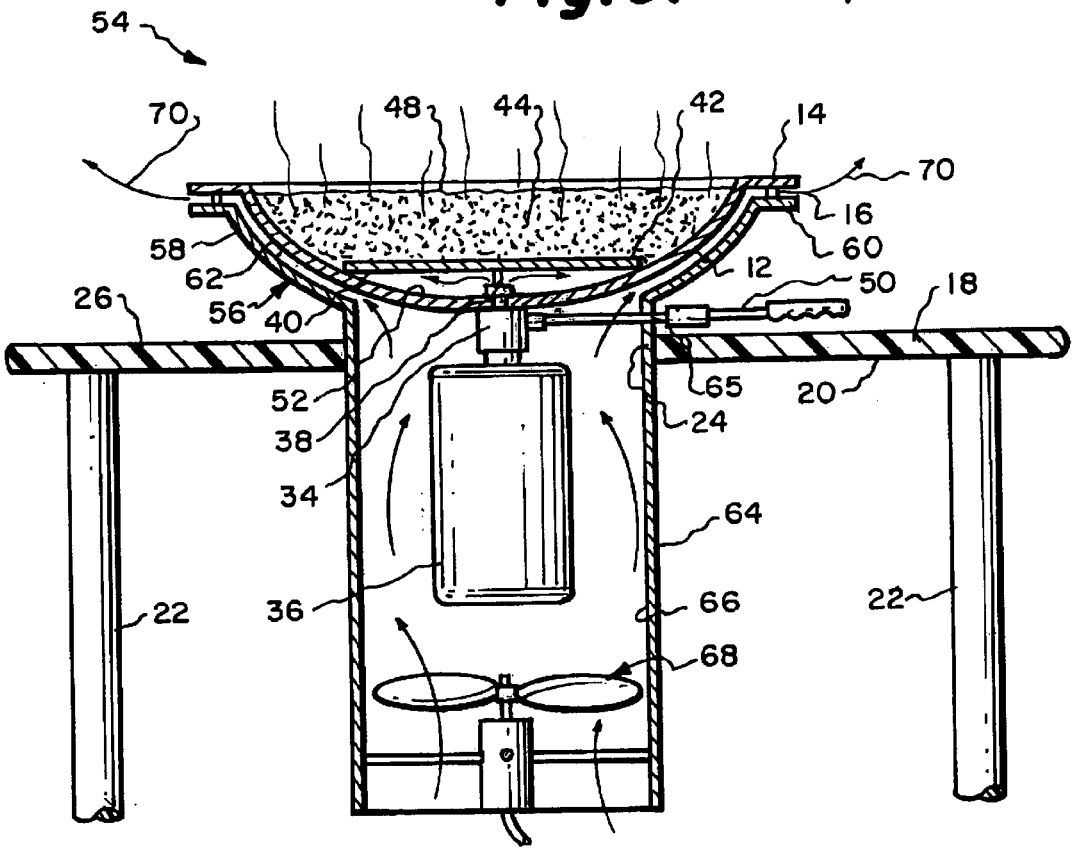
FIG. 4 is a cross-sectional view taken along line 4—4 of FIG. 3 clearly depicting the arrangement of the fire effect appliance being mounted in conjunction with a shroud where the appliance can then be used as a heater.

Referring particularly to the second embodiment 54 of this invention, which is shown in FIGS. 3 and 4, like numerals have been utilized to refer to like parts. The difference of the second embodiment 54 relative to the first embodiment 10 is that the fire bowl 12 is mounted in conjunction with a shroud 56. The shroud 56 includes an upper section 58 that is bowl shaped substantially similar to the shape of the fire bowl 12. This upper section 58 also includes an annular flange 60 with the feet 16 resting on the annular flange 60. There is formed a gap 62 between the upper section 58 and the fire bowl 12. The upper section 58 is fixedly mounted to a cylindrical section 64. The cylindrical section 64 has an internal chamber 66. Mounted at the lower end of the internal chamber 66 is an electrically operated fan 68. The function of this fan 68 is to move air through the internal chamber 66, past bottle 36, through gap 62 and to be dispensed exteriorly of the fire bowl 12, as is represented by arrows 70. The upper section 58 of the shroud 56 is to be supported in a spaced relationship above the table 18 by means of supporting feet 72. The air that is moved past and in connect with the fire bowl 12 becomes heated and therefore the second embodiment 54 of the appliance of this invention can be also used to heat areas located exteriorly of the fire bowl 12 which generally will normally comprise a plurality of seated individuals sitting around the table 18. Also, the fire bowl 12 as well as gas bottle 36 can be completely disengaged from the shroud 56 by just merely being removed therefrom. When the fire bowl 12 is so disengaged, arm 50 will be disconnected from connector 34 so it will not interfere with that disengagement. Once the fire bowl 12 is reengaged with the shroud 56, the arm 50 will be reconnected with the connector 34.

Figure 5:
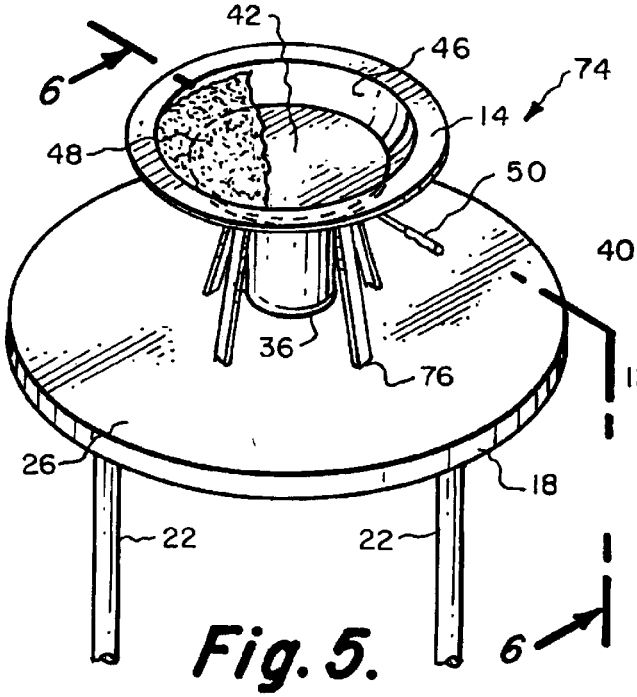
FIG. 5 is an isometric view of a third embodiment of the fire effect appliance of this invention showing a freestanding stand version thereof being located on a table supporting surface.
Figure 7:
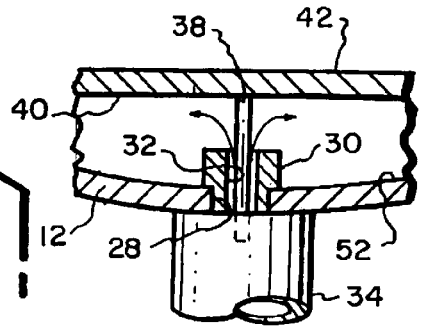
FIG. 7 is a cross-sectional view taken along line 7—7 of FIG. 6 which clearly shows the connection of the diffusing plate in conjunction with the gas discharge nozzle from the gas bottle.
Figure 6:
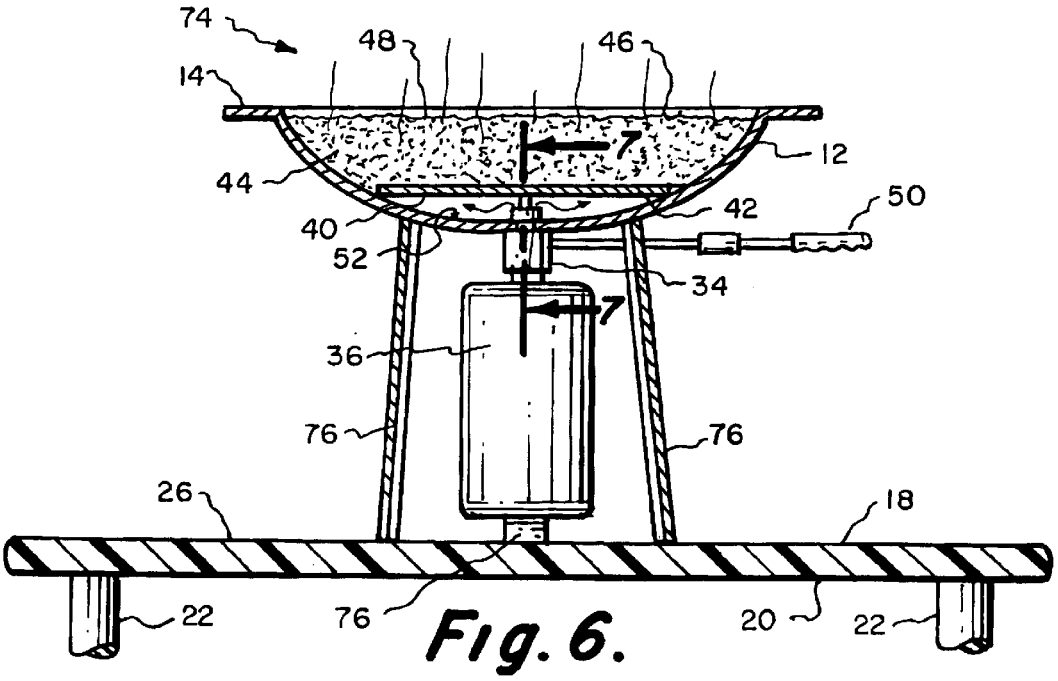
FIG. 6 is a cross-sectional view taken along line 6–6 of FIG. 5.

Referring particularly to FIGS. 5 and 6, there is shown a third embodiment 74 of the appliance of this invention. Again, like numerals have been utilized to refer to like parts. The third embodiment 74 basically comprises a freestanding unit with the fire bowl 12 being mounted on elongated legs 76. Normally, there will be at least four in number of the legs 76. These legs 76 are to rest on a supporting surface, such as upper surface 26 of table 18.

The arm 50 passes through hole 65 formed within the cylindrical section 64. The cylindrical section 64 is able to be completely disengaged from the table 18 if such is desired for cleaning and possible replacement of the particulate matter 44.

There is currently available patio tables that connect with an umbrella. These tables have a center hole about one and one half to two inches in diameter. This hole could be utilized by locating a bowl 12 on the upper surface 26 of the table 18 similar to FIG. 6 except the legs are substantially shorter in length so the fire bowl 12 is located directly adjacent the center hole. The gas bottle 36 is located at the undersurface of the table 18 with the tubular connector 34 being mounted within or directly adjacent the center hole. In this version, when it is necessary to replace the gas bottle 36 or just desire not to use the appliance, the gas bottle 36 is disconnected from the connector 34 and removed from below the table 18. The fire bowl 12 can then be removed from the upper surface 26.

What is claimed is:

1. A fire effect appliance comprising:

a fire bowl having an internal chamber;

a plate placed within said internal chamber and resting on said fire bowl, a gas supply chamber formed between said plate and said fire bowl;

a quantity of particulate matter substantially filling said internal chamber covering said diffusing means, said particulate matter having a substantially level top surface;

a center hole formed in said fire bowl, a discharge nozzle mounted within said center hole, said discharge nozzle having a through hole, said through hole connecting with said gas supply chamber, said through hole to connect with a source of flammable gas through which flammable gas is to flow into said gas supply chamber;

said plate having a bottom surface which faces said fire bowl, a centrally mounted protruding pin being mounted on said bottom surface, said centrally mounted protruding pin is to fit within said through hole to correctly align the position of said plate relative to said fire bowl with the flammable gas to be conducted around said pin into said gas supply chamber; and whereby as flammable gas is supplied to said gas supply chamber and flows in conjunction with said plate into said internal chamber the gas becomes substantially evenly dispersed through said particulate matter and when ignited produces a dancing flame effect on said top surface.

2. The fire effect appliance as defined in claim 1 wherein:

said fire bowl being mounted in conjunction with a table.

3. The fire effect appliance as defined in claim 2, wherein:

said table having a hole, said fire bowl being mounted within said hole.

4. The fire effect appliance as defined in claim 1 wherein:

a gas bottle being attached to said fire bowl, said gas bottle connecting with said center hole.

5. The fire effect appliance as defined in claim 1 wherein:

said fire bowl being mounted on a shroud, there being a gap area between said shroud and said fire bowl, an electrically operated fan connected to said shroud to move air across said fire bowl and exteriorly of said fire bowl.

6. The fire effect appliance as defined in claim 1 wherein:

said fire bowl being mounted on a stand, said stand being adapted to be located on a supporting surface.

7. The fire effect appliance as defined in claim 1, wherein:

said plate having a diameter which is within the range of fifty-seven to sixty percent of the largest diameter of the internal chamber of the fire bowl.

8. The fire effect appliance as defined in claim 7, wherein:

said particulate matter having a depth of between fourteen to eighteen percent of the largest diameter of the internal chamber of the fire bowl.

* * * * *